US006659816B2

(12) United States Patent
Fuse

(10) Patent No.: US 6,659,816 B2
(45) Date of Patent: Dec. 9, 2003

(54) WATER JET PROPELLER

(75) Inventor: Tomohiro Fuse, Saitama (JP)

(73) Assignee: Honda Gikden Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/218,577

(22) Filed: Aug. 15, 2002

(65) Prior Publication Data

US 2003/0060096 A1 Mar. 27, 2003

(30) Foreign Application Priority Data

Sep. 18, 2001 (JP) ..... 2001-284064

(51) Int. Cl.[7] ..... B63H 11/00
(52) U.S. Cl. ..... 440/38; 440/88 M
(58) Field of Search ..... 440/38, 39, 88 M, 440/40, 41, 42, 43, 46

(56) References Cited

U.S. PATENT DOCUMENTS 5,472,359 A * 12/1995 Allbright et al. ..... 440/38
5,713,769 A * 2/1998 Jones ..... 440/38
5,752,863 A * 5/1998 Baker et al. ..... 440/38

FOREIGN PATENT DOCUMENTS

JP 10119883 A 5/1998

* cited by examiner

*Primary Examiner*—S. Joseph Morano
*Assistant Examiner*—Lars A. Olson
(74) *Attorney, Agent, or Firm*—Birch, Stewart, Kolasch & Birch, LLP

(57) ABSTRACT

To simplify a mounting job for a filter and a lid at a water intake port. A filter accommodation chamber of a cylindrical shape forms a water intake port that is provided in a side wall of a stator having therein an impeller rotatably disposed. A filter of a cylindrical shape is placed in the filter accommodation chamber and an opening in the filter accommodation chamber is closed by a lid of a circular shape through either screwing or press-fitting. A flow path is integrally formed with a peripheral wall of the filter accommodation chamber. A bottom portion of the cylindrical filter is formed into an inclined surface. An inclined step portion, which abuts against an edge portion of the inclined surface of filter, is formed in the filter accommodation chamber. In addition, an opening, which communicates with the flow path when the inclined surface edge portion of the cylindrical filter and the inclined step portion abut against each other so that the two are brought into coincidence with each other, is formed in the cylindrical filter. Part of an inner peripheral surface of the filter accommodation chamber and part of an outer peripheral surface of the cylindrical filter may be formed into a flat surface.

21 Claims, 6 Drawing Sheets

FIG. 4(d)
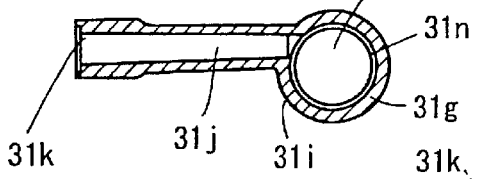
FIG. 4(c)
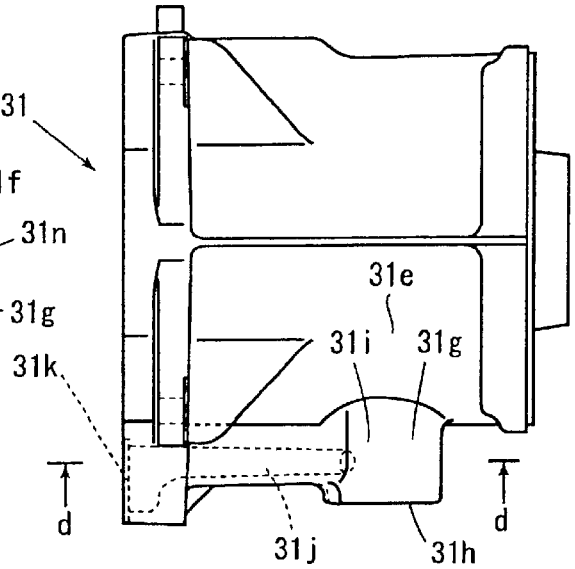
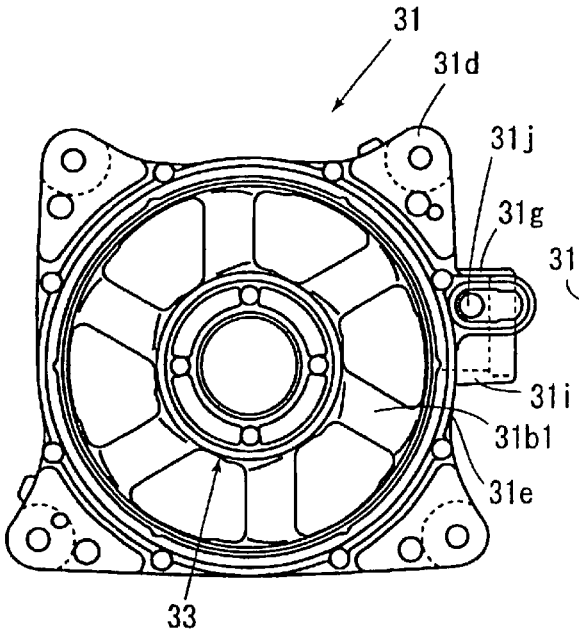
FIG. 4(a)
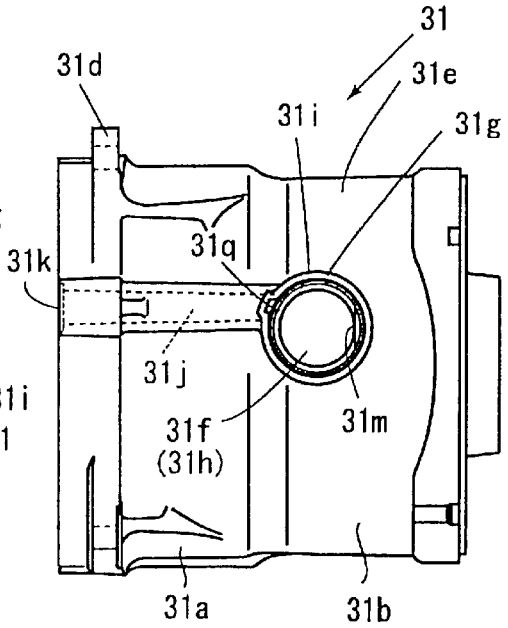
FIG. 4(b)

FIG. 5(b)
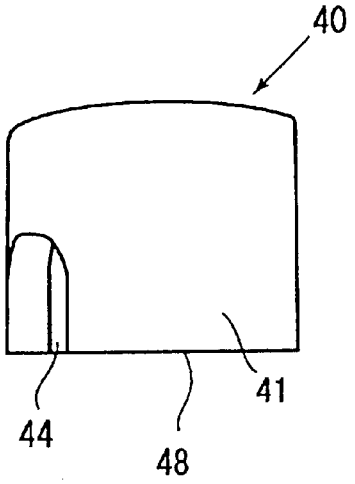
FIG. 5(d)
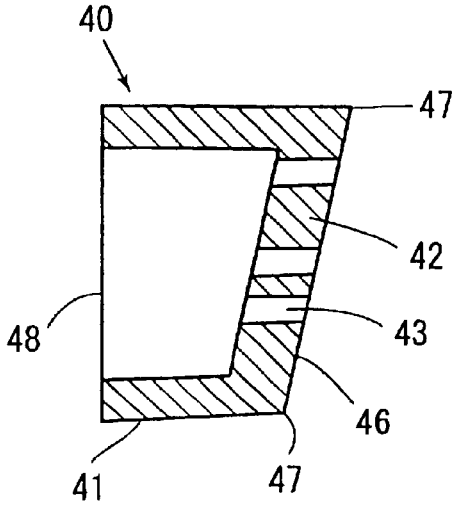
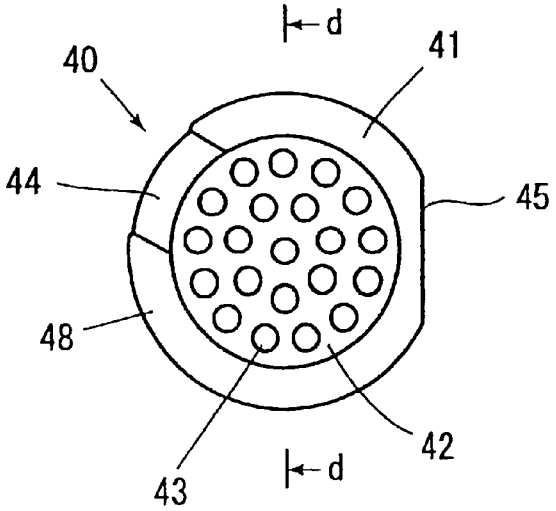
FIG. 5(a)
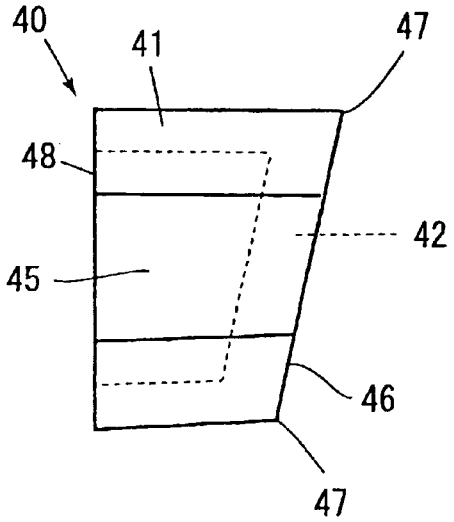
FIG. 5(c)

WATER JET PROPELLER

CROSS-REFERENCE TO RELATED APPLICATIONS

The present application claims priority under 35 USC 119 to Japanese Patent Application No. 2001-284064 filed on Sep. 18, 2001 the entire contents thereof is hereby incorporated by reference.

BACKGROUND OF THE INVENTION

1. Field of the Invention

The present invention relates to a water jet propeller used in ships and, more particularly, to a structure of a water intake port thereof.

2. Description of Background Art

Japanese Patent Laid-open No. Hei 10-119883 discloses a conventional water jet propeller.

FIGS. 6(*a*) to 6(*c*) illustrate the water jet propeller, with FIG. 6(*a*) being a cross-sectional view, FIG. 6(*b*) being an enlarged cross-sectional view taken along line b—b in FIG. 6(*a*), and FIG. 6(*c*) being a cross-sectional view taken along line c—c in FIG. 6(*a*).

The water jet propeller is mounted to a rear portion of a ship body 1. There is provided a water intake port 5 provided with a filter 4 in a side wall of a stator 3, in which an impeller 2 is rotatably disposed.

The impeller 2 is coupled to a drive shaft 6, a front portion of which is coupled to an output shaft of an engine not shown. When the impeller 2 is rotatably driven by the engine and spurts of a stream of water are sent through a nozzle 3*a* of the stator 3 to propel the ship body 1.

As shown in FIG. 6(*b*), the water intake port 5 is opened in a substantially rectangular shape. A substantially rectangular filter 4 is then mounted in this opening which, in turn, is covered with a lid member 7 which also is of a substantially rectangular shape.

The lid member 7 is provided integrally with a pipe section 7*a* that communicates with the water intake port 5. A flexible hose 9 is connected by way of a connection pipe 8 to the pipe section 7*a*. An end portion not shown of the flexible hose 9 is, in turn, connected to the engine.

When the impeller 2 is rotatably driven, therefore, part of a water stream on a downstream side thereof is supplied from the water intake port 5 to the engine by way of the filter 4 and further through the pipe section 7*a* of the lid member 7, the connection pipe 8, and the flexible hose 9, thus being used as engine coolant.

Referring to FIGS. 6(*b*) and 6(*c*), the filter 4 is provided with a flange 4*b*, while the lid member 7 is also provided with a flange 7*b*. The filter 4 and the lid member 7 are jointly fastened together using four bolts 7*c* with the flanges 4*b*, 7*b* mated to each other. Thus, the filter 4 and the lid member 7 are removably mounted with respect to the side portion of the stator 3.

According to the conventional water jet propeller described in the foregoing paragraphs, the filter 4 and the lid member 7 of the water intake port 5 are shaped into a substantially rectangle, and they are mounted to the stator 3 by jointly fastening them together using four bolts 7*c* with the flanges 4*b*, 7*b* mated to each other. This makes the mounting job extremely laborious.

SUMMARY AND OBJECTS OF THE INVENTION

It is therefore an object of the present invention to solve this problem and to provide a water jet propeller that allows a filter and a lid to be mounted with ease.

To achieve the foregoing object, according to the present invention, there is provided a water jet propeller wherein a water intake port includes a filter that is provided in a side wall of a stator containing a rotatable impeller, wherein the side wall of the stator is provided with a tubular filter accommodation chamber that forms the water intake port. A tubular filter is housed in the filter accommodation chamber and an opening is formed in a circular shape in the filter accommodation chamber and is closed by a circular lid through tightening screws or press-fitting.

According to the present invention, a flow path is integrally formed with respect to a peripheral wall of the filter accommodation chamber and a bottom portion of the tubular filter is formed by an inclined surface that is inclined with respect to an axial direction of the tubular filter. In addition, an inclined step portion is formed in the filter accommodation chamber so as to abut against and receive an edge portion of the inclined surface of the tubular filter. An opening, which communicates with the flow path when the inclined surface edge portion abuts against the inclined step portion so that the two portions are brought into coincidence with each other, is formed in the tubular filter.

According to the present invention, a flow path is integrally formed with respect to a peripheral wall of the filter accommodation chamber. An inner peripheral surface of the filter accommodation chamber and an outer peripheral surface of the tubular filter are partially formed into a flat surface. An opening, which communicates with the flow path when the flat surface portion of the tubular filter coincides with the flat surface portion of the filter accommodation chamber, is formed in the tubular filter.

In the water jet propeller according to the present invention, the water intake port that includes the filter is provided in the side wall of the stator containing the rotatable impeller. The tubular filter accommodation chamber forming the water intake port is provided in the side wall of the stator. The tubular filter is housed in the filter accommodation chamber with the circular opening formed in the filter accommodation chamber. The circular lid is either screwed or press-fitted in position to close the circular opening. According to the water jet propeller having this arrangement, the filter and the lid can be mounted to the side wall of the stator by simply closing the opening in the filter accommodation chamber through either screwing or press-fitting, after the tubular filter has been placed in the tubular filter accommodation chamber.

Namely, in the water jet propeller according to the present invention, it is remarkably easier to mount the filter and the lid than in the conventional arrangement.

According to the water jet propeller of the present invention, the flow path is integrally formed with respect to the peripheral wall of the filter accommodation chamber and the bottom portion of the tubular filter is formed by the inclined surface that is inclined with respect to the axial direction of the tubular filter, the inclined step portion is formed in the filter accommodation chamber so as to abut against and receive the edge portion of the inclined surface of the tubular filter. The opening, which communicates with the flow path when the inclined surface edge portion abuts against the inclined step portion so that the two portions are brought into coincidence with each other, is formed in the tubular filter. All this offers the following function.

Namely, in the conventional water jet propeller described earlier, the flow path from the filter accommodation chamber is formed by the pipe section 7*a* that is integrated with the lid member 7. Therefore, if the lid member 7 is mounted in a reverse direction with respect to a fore-and-aft direction, the flow path 7*a* is also mounted in a reverse direction with respect to the fore-and-aft direction. More attention should therefore be paid to the mounting of the lid member 7, thus making the mounting job even more laborious.

According to the water jet propeller of the present invention, on the other hand, the problems inherent in the conventional technology will not occur, since the flow path is formed integrally with respect to the peripheral wall of the filter accommodation chamber.

In addition, the bottom portion of the tubular filter is formed by the inclined surface that is inclined with respect to the axial direction of the tubular filter, the inclined step portion is formed in the filter accommodation chamber so as to abut against and receive the edge portion of the inclined surface of the tubular filter. In view of the opening, which communicates with the flow path when the inclined surface edge portion abuts against the inclined step portion so that the two portions are brought into coincidence with each other, formed in the tubular filter, the flow path in the filter accommodation chamber and the opening in the filter are automatically brought into communication with each other when the tubular filter is inserted in the filter accommodation chamber and the edge portion of the inclined surface of the tubular filter abuts against (or fit into) the inclined step portion of the filter accommodation chamber.

This helps make the mounting job of the filter and the lid even easier.

According to the water jet propeller of the present invention, the flow path is integrally formed with respect to the peripheral wall of the filter accommodation chamber. The inner peripheral surface of the filter accommodation chamber and the outer peripheral surface of the tubular filter are partially formed into the flat surface and the opening, which communicates with the flow path when the flat surface portion of the tubular filter coincides with the flat surface portion of the filter accommodation chamber, is formed in the tubular filter. This offers the following additional function.

Namely, as described earlier, in the conventional water jet propeller, the flow path from the filter accommodation chamber is formed by the pipe section 7*a* that is integrated with the lid member 7 and, therefore, if the lid member 7 is mounted in a reverse direction with respect to the fore-and-aft direction, the flow path 7*a* is also mounted in a reverse direction with respect to the fore-and-aft direction. More attention should therefore be paid to the mounting of the lid member 7, thus making the mounting job even more laborious.

According to the present invention, on the other hand, the problems inherent in the conventional technology will not occur, since the flow path is formed integrally with respect to the peripheral wall of the filter accommodation chamber.

Since the inner peripheral surface of the filter accommodation chamber and the outer peripheral surface of the tubular filter are partially formed into the flat surface, and the opening, which communicates with the flow path when the flat surface portion of the tubular filter coincides with the flat surface portion of the filter accommodation chamber, is formed in the tubular filter, the flow path in the filter accommodation chamber and the opening in the filter are automatically brought into communication with each other when the tubular filter is inserted in the filter accommodation chamber so that both of the above-mentioned flat surface portions coincide with each other.

Therefore, the job of mounting the filter and the lid becomes even easier.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 4(*a*)–4(*d*) illustrate a stator 31 of the jet pump 30, FIG. 4(*a*) being a front elevational view (looking the ship body from the front), FIG. 4(*b*) being a side elevational view, FIG. 4(*c*) being a plan view of FIG. 4(*b*), and FIG. 4(*d*) being a cross-sectional view taken along line d—d in FIG. 4(*c*);

FIGS. 5(*a*)–5(*d*) illustrate a filter, FIG. 5(*a*) being a side elevational view (as viewed from the side of the ship body from a side), FIG. 5(*b*) being a plan view of FIG. 5(*a*), FIG. 5(*c*) being a side elevational view of FIG. 5(*a*), and FIG. 5(*d*) being a cross-sectional view taken along d—d in FIG. 5(*a*)

DETAILED DESCRIPTION OF THE PREFERRED EMBODIMENTS

The embodiments of the present invention will be described with reference to the accompanying drawings.

Figure 1:
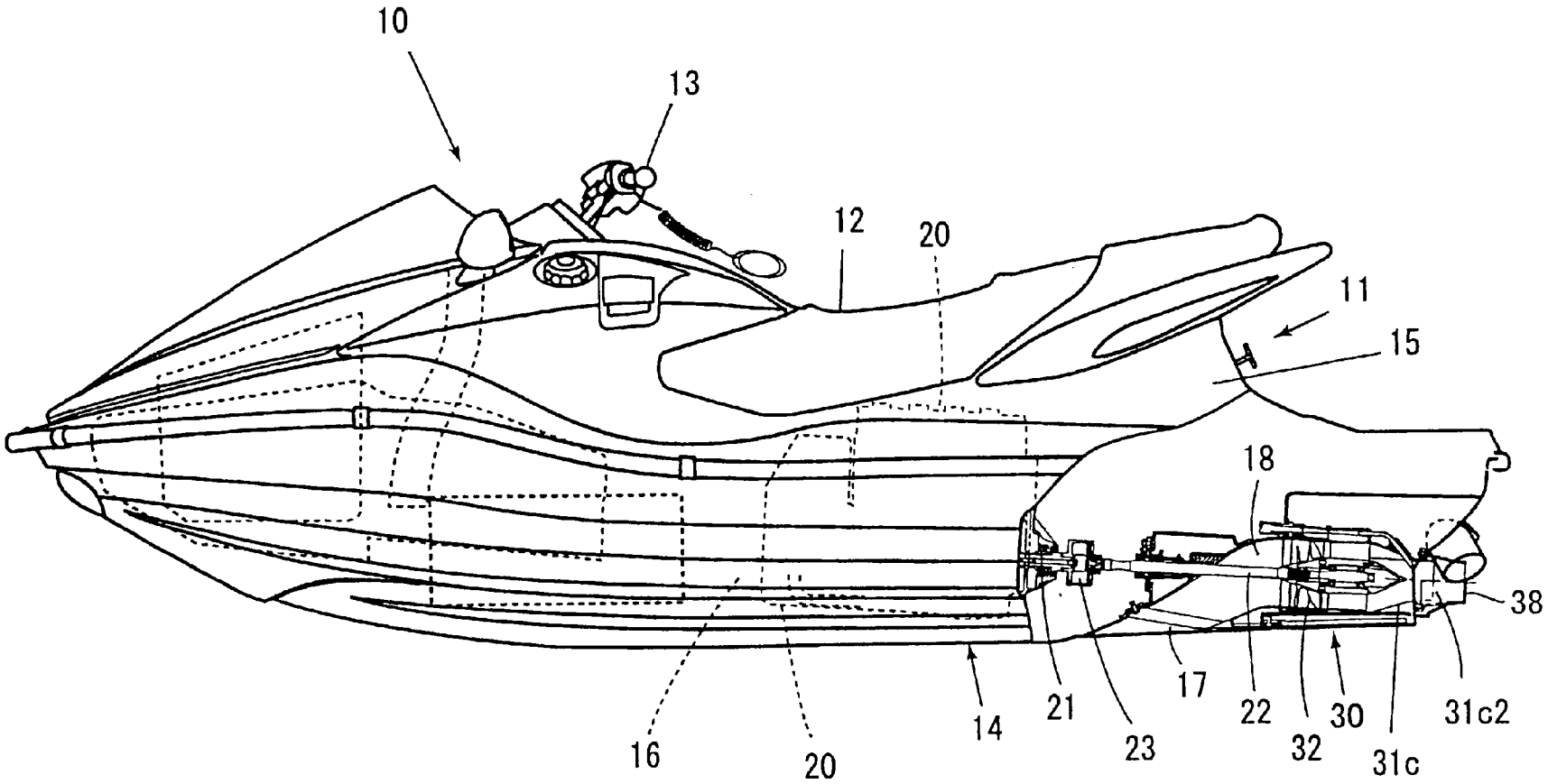
FIG. 1 is a partly cutaway schematic side elevational view showing a typical small planing boat employing one embodiment of a water jet propeller according to the present invention.
Figure 2:
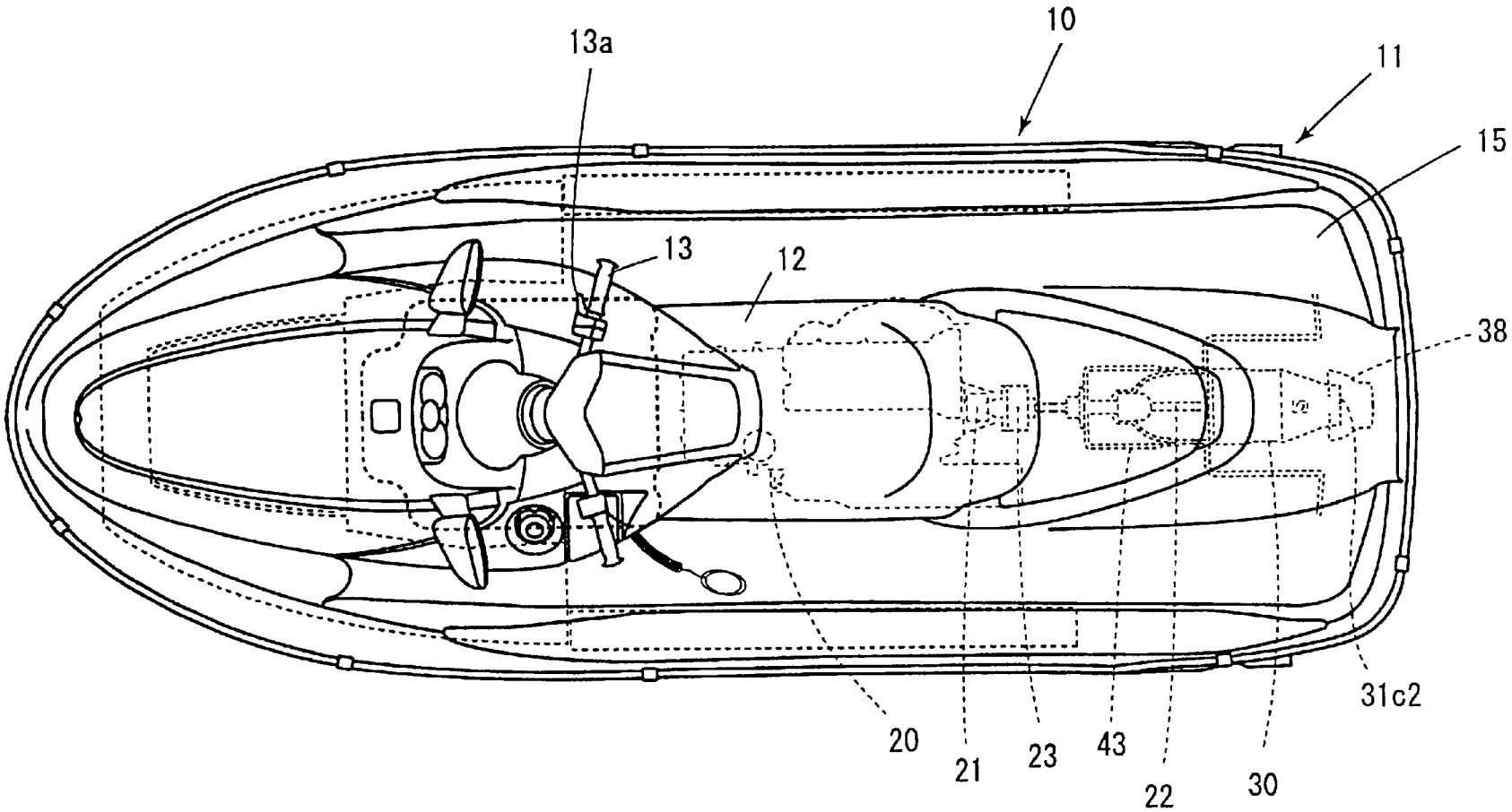
FIG. 2 is a schematic plan view showing the same.

FIG. 1 is a partly cutaway schematic side elevational view showing a typical small planing boat employing one embodiment of a water jet propeller according to the present invention. FIG. 2 is a schematic plan view showing the same.

As shown in FIGS. 1 and 2, a small planing boat 10 is a riding type small watercraft, in which a passenger sits on a seat 12 on a ship body 11 and grips a handlebar 13 provided with a throttle lever to steer the boat.

The ship body 11 is of a floating body structure that forms a space 16 internally between a hull 14 and a deck 15 joined to each other. An engine 20 is installed on the hull 14 inside the space 16. In addition, a water jet propeller (hereinafter referred to also as a jet pump) 30 is provided as a propulsion means driven by the engine 20 that is installed in a rear portion of the hull 14.

The jet pump 30 is provided with an impeller 32 disposed inside a flow path 18 that extends from a water inlet port 17 opened in a bottom of the boat to a jet port 31*c*2 opened in a trailing edge of the ship body. A deflector 38 is provided adjacent to the jet port 31*c*2. A shaft (drive shaft) 22 for driving the impeller 32 is coupled to an output shaft 21 of the engine 20 by way of a coupler 23. When the impeller 32 is rotatably driven by the engine 20 through the coupler 23 and the shaft 22 spurts of water taken in through the water inlet port 17 are sent from the jet port 31*c*2 through the deflector 38, thus propelling the ship body 11. A driving speed of the engine 20, or a propulsion force provided by the jet pump 30, is controlled by circularly moving a throttle lever 13*a* (see FIG. 2) of the handlebar 13 either forward or backward. The deflector 38 is connected to the handlebar 13 through a control cable not shown. It is operated as the handlebar 13 is turned either forward or backward as necessary to change a direction of travel of the ship body 11.

Figure 3B:
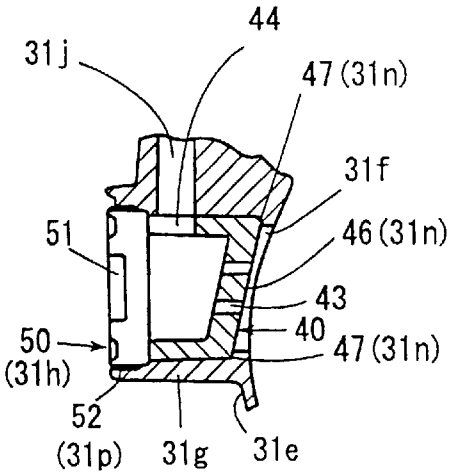
FIGS. 3(*a*)–3(*b*) illustrate the jet pump 30, FIG. 3(*a*) being a fragmentary side sectional view and FIG. 3(*b*) being a cross-sectional view taken along line b—b in FIG. 3(*a*)
Figure 3A:
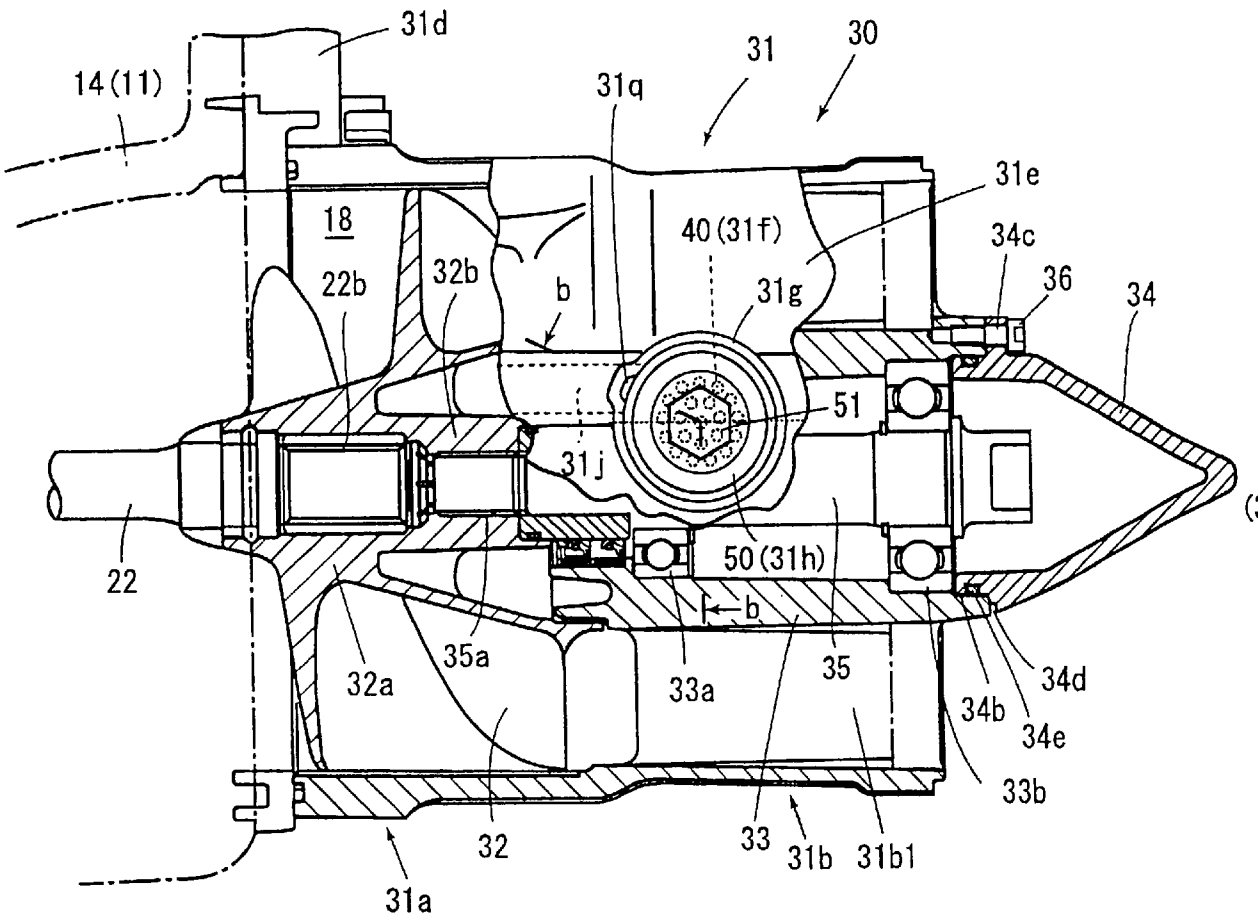
Figure 6A:
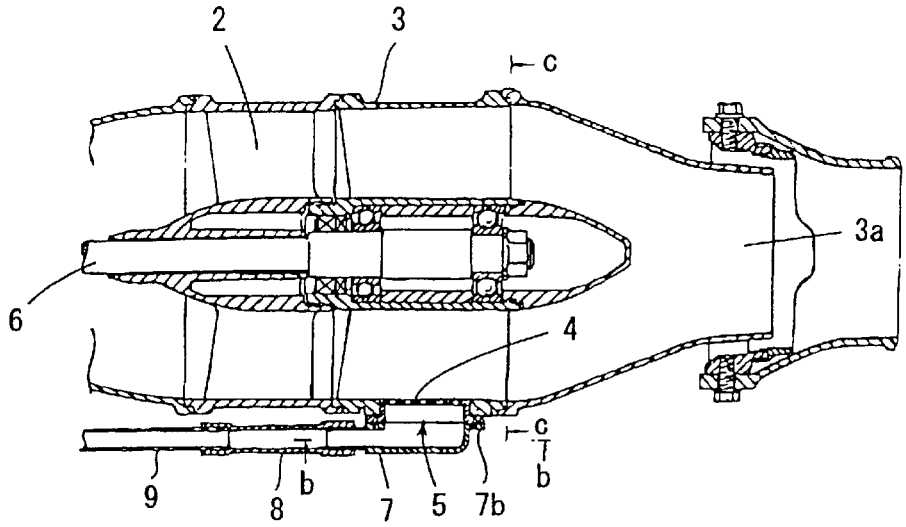
FIG. 6(a) PRIOR ART
FIGS. 6(*a*), 6(*b*) and 6(*c*) are explanatory drawings of the conventional technology.
Figure 6B:
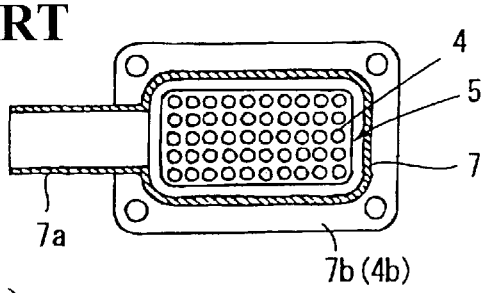
FIG. 6(b) PRIOR ART
Figure 6C:
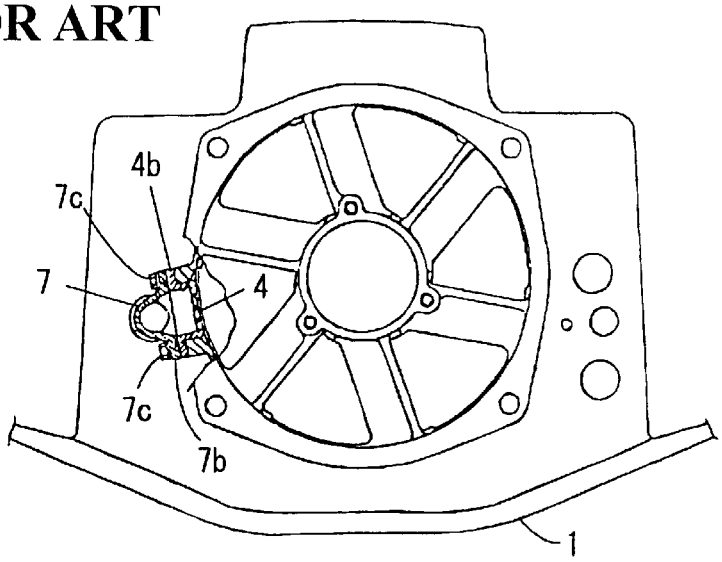
FIG. 6(c) PRIOR ART

Referring to FIGS. 3(*a*) and 3(*b*), the jet pump 30 is provided with a stator (duct) 31 that forms the flow path 18 communicating with the water inlet port 17 (see FIG. 1) provided in the bottom portion of the ship body 11, with the impeller 32 disposed inside the stator 31. A bearing portion 33 of the impeller is provided inside the stator 31. A cap 34 plugs up a trailing edge of the bearing portion 33.

The jet pump 30 is mounted removably to the hull 14 when a flange portion 31*d* (see FIGS. 4(*a*)–4(*d*)) formed at a front portion of the stator 31 is secured to the hull 14 using bolts not shown.

The stator 31 is provided with an impeller accommodation portion 31*a*, inside which the impeller 32 is disposed, a bearing accommodation portion 31*b*, and a nozzle portion 31*c* (see FIG. 1). The impeller accommodation portion 31*a* and the bearing accommodation portion 31*b* are formed integrally with each other. The bearing portion 33 is formed integrally within the bearing accommodation portion 31*b* through a stator blade 31*b* 1.

A front portion of a boss portion 32*a* of the impeller 32 is engaged with splines 22*b* formed on a rear end of the drive shaft 22 and the impeller 32 turns with the drive shaft 22. As noted earlier, the leading edge of the drive shaft 22 is coupled to the output shaft 21 of the engine 20 mounted in the ship body 11 through the coupler 23 (FIG. 1).

An impeller shaft 35, which supports a rear portion 32*b* of the boss portion 32*a* of the impeller 32, is rotatably supported on the bearing portion 33 through ball bearings 33*a*, 33*b*. External threads 35*a* are formed on a leading edge of the impeller shaft 35. The external threads 35*a* engage internal threads formed on the rear portion 32*b* of the boss portion of the impeller 32, which provides a connection between the impeller 32 and the impeller shaft 35.

In summary, the front portion of the boss portion 32*a* of the impeller 32 is coupled to the shaft 22, while the rear portion 32*b* of the boss portion is coupled to the impeller shaft 35, which allows the impeller 32 to turn with the shaft 22 and the impeller shaft 35.

There are formed, at a front portion of the cap 34, an insertion portion (a cylindrical portion) 34*b* to be inserted into a rear portion of the bearing portion 33 and three (only one is shown) insertion holes 34*c* for a screw 36 (see FIG. 3(*a*)). A groove, into which an O-ring 34*e* is mounted, is formed at the cylindrical insertion portion 34*b*.

The cap 34 is therefore mounted to the rear portion of the bearing portion 33 as follows. Namely, the insertion portion 34*b* is inserted (press-fitted) into the rear portion of the bearing portion 33 with the O-ring 34*e* mounted to the insertion portion 34*b* as shown in FIG. 3(*a*) and the screw 36 is finally tightened.

A partial cutout 34*d* is formed on an abutting surface between the cap 34 and the bearing portion 33. During maintenance service procedures, the cap 34 can be easily removed by inserting a tip of a tool (for example, a screwdriver) into this cutout 34*d* with the screw 36 removed.

Referring to FIGS. 3 and 4, a filter accommodation chamber 31*g* of a tubular shape (a cylindrical shape according to the embodiment) is formed integrally on a side wall 31*e* of the stator 31, serving to form a water intake port 31*f* in a portion downstream of the impeller 32. A filter 40 of a tubular shape (a cylindrical shape according to the embodiment) is housed in the filter accommodation chamber 31*g* as shown in FIG. 3(*b*). An opening 31*h* in the filter accommodation chamber 31*g* is closed by a circular lid 50 that is screwed into position. The opening 31*h* may instead be closed by press-fitting the lid 50.

Referring to FIGS. 4(*a*)–4(*d*), a flow path 31*j*, through which water from the water intake port 31*f* flows in, is integrally formed in a peripheral wall 31*i* of the filter accommodation chamber 31*g*. A coolant hose is connected to an end portion 31*k* of the flow path 31*j* by way of a joint pipe not shown, through which coolant is supplied to the engine 20.

Referring to FIGS. 5(*a*)–5(*d*), the filter 40 is provided with a cylindrical portion 41 and a bottom portion 42 formed integrally therewith. A number of holes 43 are made in the bottom portion 42. The diameter of each of the holes 43 should be about 3 mm.

In addition, there is formed an opening 44 of a U-shaped cutout in the cylindrical portion 41.

Referring to FIG. 4(*b*), part of an inner peripheral surface of the filter accommodation chamber 31*g* is formed into a flat surface (the flat surface portion is indicated by a reference numeral 31*m*). Referring further to FIGS. 5(*a*) and 5(*c*), part of an outer peripheral surface of the tubular filter 40 is also shaped into a flat surface (the flat surface portion is indicated by a reference numeral 45).

When the filter 40 is inserted into the filter accommodation chamber 31*g*, therefore, unless these flat surface portions 31*m* and 45 are properly aligned with each other, the filter 40 cannot be inserted. When the filter 40 is inserted into the filter accommodation chamber 31*g* with the flat surface portions 31*m* and 45 aligned, the opening 44 in the filter 40 opposes the flow path 31*j* in the filter accommodation chamber 31*g* brings the two into communication with each other [see FIG. 3(*b*)].

Furthermore, according to the embodiment, the bottom portion 42 of the tubular filter 40 is formed by an inclined surface 46 that is inclined with respect to an axial direction [a right-and-left direction in FIGS. 5(*c*) and 5(*d*)] of the tubular filter 40, as shown in FIGS. 5(*a*)–5(*d*). As shown further in FIG. 3(*b*) and FIG. 4(*d*), an inclined step portion 31*n*, which abuts against and receives an edge portion 47 of the inclined surface 46 of the tubular filter 40, is formed in the filter accommodation chamber 31*g*.

When the filter 40 is inserted into the filter accommodation chamber 31*g*, therefore, the inclined surface 46 at the bottom portion 42 of the filter must be brought into coincidence with the inclined step portion 31*n* of the filter accommodation chamber 31*g*, otherwise, a head portion 48 of the filter 40 protrudes from the filter accommodation chamber 31*g*, thus preventing the filter 40 from being completely housed in the filter accommodation chamber 31*g*, which hampers the lid 50 from being mounted in position. If the inclined surface 46 of the filter bottom portion 42 is brought into coincidence with the inclined step portion 31*n* of the filter accommodation chamber 31*g* as the filter is inserted into the filter accommodation chamber 31*g*, the opening 44 in the filter 40 opposes the flow path 31*j* in the filter accommodation chamber 31*g*, bringing the two into communication with each other [see FIG. 3(*b*)].

According to this embodiment, the following two arrangements are employed; namely:

an arrangement, in which partial flat surface portions 31*m* and 45 are formed on the inner peripheral surface of the filter accommodation chamber 31*g* and the outer peripheral surface of the filter 40; and, ii. an arrangement, in which the bottom portion 42 of the tubular filter 40 is made into the inclined surface 46 and the inclined step portion 31*n* is formed in the filter accommodation chamber 31*g*.

It is nonetheless possible to employ either one of these two arrangements i and ii.

Referring to FIGS. 3(*a*)–3(*b*), a hexagon recessed portion 51 is formed in the lid 50 at a head portion thereof and, in addition, external threads 52 are formed on an outer periphery thereof. Internal threads 31*p* are formed, on the other hand, on an inner peripheral surface on an upper portion of the filter accommodation chamber 31*g*.

The opening 31*h* in the filter accommodation chamber 31*g* can be easily plugged with the lid 50 by a manner that when, after the filter 40 has been housed in the filter accommodation chamber 31*g* as described above, the two types of threads 52, 31*p* are brought into threaded engagement with each other by a tool engaged in the hexagon recessed portion 51 in the lid.

According to the embodiment, referring to FIG. 3(*a*) and FIG. 4(*b*), there is provided a partial recessed portion 31*q* on an inner peripheral surface in the opening 31*h* of the filter accommodation chamber 31*g*. After the lid 50 has been mounted in the opening 31*h* of the filter accommodation chamber 31*g*, a tool is inserted into the recessed portion 31*q* for collapsing the threads 52 in the lid 50, thereby preventing the lid 50 from thereafter turning and thus preventing the lid 50 from coming off the filter accommodation chamber 31*g*.

According to the water jet propeller having arrangements as described above, the following operational effects can be achieved.

The tubular filter accommodation chamber 31*g* that forms the water intake port 31*f* is provided on the side wall 31*e* of the stator 31, inside which the impeller 32 is rotatably disposed. The tubular filter 40 is housed in the filter accommodation chamber 31*g*. The opening 31*h* is formed circularly in the filter accommodation chamber 31*g* and is closed by the circular lid 50 through screwing or press-fitting. Thanks to this arrangement, the filter 40 and the lid 50 can be mounted to the side wall 31*e* of the stator 31 by placing the tubular filter 40 in the tubular filter accommodation chamber 31*g* and closing the opening 31*h* in the filter accommodation chamber 31*g* with the circular lid 50 through screwing or press-fitting.

Namely, according to this water jet propeller, the mounting job of the filter 40 and the lid 50 is made remarkably simpler as compared with the conventional type.

(b) The flow path 31*j* is integrally formed with respect to the peripheral wall of the filter accommodation chamber 31*g*. The bottom portion of the tubular filter 40 is formed by the inclined surface 46 that is inclined with respect to the axial direction of the tubular filter. The inclined step portion 31*n*, which abuts against and receives the edge portion 47 of the inclined surface 46 of the tubular filter 40, is formed in the filter accommodation chamber 31*g*. In addition, the opening 44, formed in the tubular filter 40, communicates with the flow path 31*j* when the inclined surface edge portion 47 and the inclined step portion 31*n* abut against each other so as to bring the two into coincidence with each other. These arrangements offer the following additional operational effects.

Namely, in the conventional water jet propeller described earlier, the flow path from the filter accommodation chamber is formed by the pipe section 7*a* formed integrally with the lid member 7. As a result, if the lid member 7 is mounted in a reverse direction with respect to a fore-and-aft direction, the flow path 7*a* is also mounted in a reverse direction with respect to the fore-and-aft direction. More attention should therefore be paid to the mounting of the lid member 7, thus making the mounting job even more laborious.

According to the water jet propeller according to the embodiment of the present invention, on the other hand, such a problem inherent in the conventional technology will not occur, since the flow path 31*j* is formed integrally with respect to the peripheral wall of the filter accommodation chamber 31*g*.

Furthermore, the bottom portion of the tubular filter 40 is formed by the inclined surface 46 that is inclined with respect to the axial direction of the tubular filter. The inclined step portion 31*n*, which abuts against and receives the edge portion 47 of the inclined surface 46 of the tubular filter 40, is formed in the filter accommodation chamber 31*g*. In addition, the opening 44, formed in the tubular filter 40, communicates with the flow path 31*j* when the inclined surface edge portion 47 and the inclined step portion 31*n* abut against each other so as to bring the two into coincidence with each other. The flow path 31*j* in the filter accommodation chamber 31*g* and the opening 44 in the filter 40 are automatically brought into communication with each other. Therefore, when the tubular filter 40 is inserted in the filter accommodation chamber 31*g* the edge portion 47 of the inclined surface 46 of the tubular filter 40 abuts against (or fit into) the inclined step portion 31*n* of the filter accommodation chamber 31*g*.

This helps make the mounting job of the filter 40 and the lid 50 even easier.

(c) Part of the inner peripheral surface of the filter accommodation chamber 31*g* and part of the outer peripheral surface of the tubular filter 40 are formed into a flat surface (31*m*, 45). In addition, there is formed in the tubular filter 40 the opening 44 that communicates with the flow path 31*j* when the flat surface portion 45 of the tubular filter 40 and the flat surface portion 31*m* of the filter accommodation chamber 31*g* are brought into coincidence with each other. When the tubular filter 40 is inserted into the filter accommodation chamber 31*g* so as to bring the two flat surface portions 31*m* and 45 into coincidence with each other, it automatically causes the flow path 31*j* in the filter accommodation chamber 31*g* to communicate with the opening 44 in the filter 40.

The mounting job for the filter 40 and the lid 50 will therefore become even easier.

While the invention has been described with reference to preferred embodiments thereof, it is to be understood that the invention is not limited to the preferred embodiments or structures. Rather, the invention is intended to cover various modifications within the spirit and scope of the invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A water jet propeller including a water intake port having a filter being disposed therein and being provided in a side wall of a stator containing a rotatable impeller comprising:

a tubular filter accommodation chamber being formed in the side wall of the stator, said tubular filter accommodation chamber forming the water intake port;

a tubular filter being positioned within the filter accommodation chamber; and an opening formed in a circular shape in the filter accommodation chamber and being closed by a circular lid with screw threads.

2. The water jet propeller according to claim 1, wherein a flow path is integrally formed with respect to a peripheral wall of the filter accommodation chamber, a bottom portion of the tubular filter is formed by an inclined surface that is inclined with respect to an axial direction of the tubular filter, an inclined step portion is formed in the filter accommodation chamber so as to abut against and receive an edge portion of the inclined surface of the tubular filter, and an opening, which communicates with the flow path when the inclined surface edge portion abut against the inclined step portion so that the two portions are brought into coincidence with each other, is formed in the tubular filter.

3. The water jet propeller according to claim 1, wherein a flow path is integrally formed with respect to a peripheral wall of the filter accommodation chamber, an inner peripheral surface of the filter accommodation chamber and an outer peripheral surface of the tubular filter are partially formed into a flat surface, and an opening, which communicates with the flow path when the flat surface portion of the tubular filter coincides with the flat surface portion of the filter accommodation chamber, is formed in the tubular filter.

4. The water jet propeller according to claim 2, wherein said tubular filter is cylindrical in shape and includes the inclined surface formed integrally therewith, said inclined surface forming a bottom of said tubular filter.

5. The water jet propeller according to claim 4, wherein said inclined surface includes a plurality of apertures in communication with water being disposed within said stator.

6. The water jet propeller according to claim 3, wherein the opening in said tubular filter extends from one end that is brought into communication with a flow path when said tubular filter is inserted into said filter accommodation chamber with said flat surface being aligned relative to each other.

7. The water jet propeller according to claim 6, wherein the flat surface on said tubular filter is offset by a predetermined angle relative to said opening in said tubular filter.

8. A water jet propeller including a water intake port having a filter being disposed therein and being provided in a side wall of a stator containing a rotatable impeller comprising:

a tubular filter accommodation chamber being formed in the side wall of the stator, said tubular filter accommodation chamber forming the water intake port;

a tubular filter being positioned within the filter accommodation chamber; and an opening formed in a circular shape in the filter accommodation chamber and being closed by a circular lid by press-fitting.

9. The water jet propeller according to claim 8, wherein a flow path is integrally formed with respect to a peripheral wall of the filter accommodation chamber, a bottom portion of the tubular filter is formed by an inclined surface that is inclined with respect to an axial direction of the tubular filter, an inclined step portion is formed in the filter accommodation chamber so as to abut against and receive an edge portion of the inclined surface of the tubular filter, and an opening, which communicates with the flow path when the inclined surface edge portion abut against the inclined step portion so that the two portions are brought into coincidence with each other, is formed in the tubular filter.

10. The water jet propeller according to claim 8, wherein a flow path is integrally formed with respect to a peripheral wall of the filter accommodation chamber, an inner peripheral surface of the filter accommodation chamber and an outer peripheral surface of the tubular filter are partially formed into a flat surface, and an opening, which communicates with the flow path when the flat surface portion of the tubular filter coincides with the flat surface portion of the filter accommodation chamber, is formed in the tubular filter.

11. The water jet propeller according to claim 9, wherein said tubular filter is cylindrical in shape and includes the inclined surface formed integrally therewith, said inclined surface forming a bottom of said tubular filter.

12. The water jet propeller according to claim 11, wherein said inclined surface includes a plurality of apertures in communication with water being disposed within said stator.

13. The water jet propeller according to claim 10, wherein the opening in said tubular filter extends from one end that is brought into communication with a flow path when said tubular filter is inserted into said filter accommodation chamber with said flat surface being aligned relative to each other.

14. The water jet propeller according to claim 13, wherein the flat surface on said tubular filter is offset by a predetermined angle relative to said opening in said tubular filter.

15. A cooling water flow path adapted for use in cooling an engine comprising:

a water intake port having a filter being disposed therein and being provided in a side wall of a stator containing a rotatable impeller:

a tubular filter accommodation chamber being formed in the side wall of the stator, said tubular filter accommodation chamber forming the water intake port;

a tubular filter being positioned within the filter accommodation chamber; and an opening formed in a circular shape in the filter accommodation chamber and being closed by a circular lid;

wherein water supplied from said water intake port and through said tubular filter is adapted for being supplied to an engine for cooling the engine.

16. The cooling water flow path adapted for use in cooling an engine according to claim 15, wherein a flow path is integrally formed with respect to a peripheral wall of the filter accommodation chamber, a bottom portion of the tubular filter is formed by an inclined surface that is inclined with respect to an axial direction of the tubular filter, an inclined step portion is formed in the filter accommodation chamber so as to abut against and receive an edge portion of the inclined surface of the tubular filter, and an opening, which communicates with the flow path when the inclined surface edge portion abut against the inclined step portion so that the two portions are brought into coincidence with each other, is formed in the tubular filter.

17. The cooling water flow path adapted for use in cooling an engine according to claim 15, wherein a flow path is integrally formed with respect to a peripheral wall of the filter accommodation chamber, an inner peripheral surface of the filter accommodation chamber and an outer peripheral surface of the tubular filter are partially formed into a flat surface, and an opening, which communicates with the flow path when the flat surface portion of the tubular filter coincides with the flat surface portion of the filter accommodation chamber, is formed in the tubular filter.

18. The cooling water flow path adapted for use in cooling an engine according to claim 16, wherein said tubular filter is cylindrical in shape and includes the inclined surface formed integrally therewith, said inclined surface forming a bottom of said tubular filter.

19. The cooling water flow path adapted for use in cooling an engine according to claim 18, wherein said inclined surface includes a plurality of apertures in communication with water being disposed within said stator.

20. The cooling water flow path adapted for use in cooling an engine according to claim 17, wherein the opening in said tubular filter extends from one end that is brought into communication with a flow path when said tubular filter is inserted into said filter accommodation chamber with said flat surface being aligned relative to each other.

21. The cooling water flow path adapted for use in cooling an engine to claim 20, wherein the flat surface on said tubular filter is offset by a predetermined angle relative to said opening in said tubular filter.

* * * * *